US005905929A

United States Patent [19]

Cho et al.

[11] Patent Number: 5,905,929

[45] Date of Patent: May 18, 1999

[54] ELECTROPHOTOGRAPHIC PRINTER

[75] Inventors: Sung-min Cho, Seoul; Kwang-ho No; In-yong Song, both of Suwon, all of Rep. of Korea

[73] Assignee: Samsung Electronics Co., Ltd., Kyungki-do, Rep. of Korea

[21] Appl. No.: 09/098,417

[22] Filed: Jun. 16, 1998

[30] Foreign Application Priority Data

Dec. 8, 1997 [KR] Rep. of Korea ..... 97-66764

[51] Int. Cl.[6] ..... G03G 15/11; G03G 15/16

[52] U.S. Cl. ..... 399/251; 399/296

[58] Field of Search ..... 399/237, 251, 399/168, 128, 296

[56] References Cited

U.S. PATENT DOCUMENTS 4,461,561 7/1984 Plumadore ..... 399/251 X
5,815,779 9/1998 Abramsohn ..... 399/296 X

*Primary Examiner*—S. Lee
*Attorney, Agent, or Firm*—Sughrue, Mion, Zinn, Macpeak & Seas, PLLC

[57] ABSTRACT

An electrophotographic printer including: a photosensitive belt moving along a circular path and supported by a plurality of rollers; a main corona device for increasing an electrical charge potential on a surface of the photosensitive belt to a predetermined level for development; first, second, third and fourth laser scanning units for forming an electrostatic latent image on the photosensitive belt by color; first, second, third and fourth developing units for individually developing the electrostatic latent image using first, second, third and fourth developing solutions of different colors; a drying roller pressing the photosensitive belt for removing carrier from the developing solutions developed on the photosensitive belt, the drying roller being frictionally charged positively through contact with the photosensitive belt; an eraser for removing an electrostatic charge remaining on the photosensitive belt after development to uniformly electrify the surface of the photosensitive belt with exposing charge potential; and a potential-increasing electrifying unit for increasing the electrical charge potential on the surface of the photosensitive belt, which was lowered during previous developing, to a level for performing further developing using a different development solution.

6 Claims, 6 Drawing Sheets

ELECTROPHOTOGRAPHIC PRINTER

BACKGROUND OF THE INVENTION

1. Field of the Invention

The present invention relates to an electrophotographic printer, and more particularly, to an electrophotographic printer capable of preventing sticking of toner on the surface of a drying roller during the step of firmly adhering a developed image on a photosensitive medium, thereby improving print quality.

2. Description of the Related Art

FIG. 1 is a diagram schematically showing the structure of a conventional electrophotographic printer.

As shown in FIG. 1, the conventional electrophotographic printer includes a photosensitive belt 10 making a circular movement and three rollers including first, second and third rollers 21, 22 and 23 which are fixed at predetermined positions, to circulate the photosensitive belt 10 in a closed circuit. The third roller 23 is a driving roller for driving the photosensitive belt 10 by a driving force of a driving motor (not shown) and the second roller 22 is a steering roller for preventing slanted traveling by controlling the tension of the photosensitive belt 10. A drying roller 50 for drying a developing solution adhered to the photosensitive belt 10 while pressing the photosensitive belt 10 against the third roller 23 is placed near the third roller 23. Also, a transfer roller 24 is placed next to the first roller 21. An image formed on the photosensitive belt 10 is transferred to the transfer roller 24 as it rolls along the photosensitive belt 10. A pressing roller 25 is for transferring the image transferred onto the transfer roller 24 on a printing paper 60 by pressing the printing paper against the transfer roller 24. The pressing roller 25 is installed near the transfer roller 24.

At one end of the photosensitive belt 10 between the first and second rollers 21 and 22, is an eraser 34 for erasing an electrostatic charge of an electrostatic latent image remaining on the surface of the photosensitive belt 10. A main corona device 35 is placed next to the eraser 34, for electrifying the charge on the photosensitive belt 10 to a predetermined level such that the developing solution is developed.

Below the photosensitive belt 10, is a plurality of laser scanning units (LSUs) 30 for forming an electrostatic latent image by irradiating laser beams on the photosensitive belt 10 according to an image signal, and a plurality of developing units 40 alternating with the LSUs 30 for developing the electrostatic latent image by supplying a developing solution containing toner with a predetermined color to an area having the electrostatic latent image.

In the electrophotographic printer having the above structure, each LSU 30 forms an electrostatic latent image by irradiating light on the conveyed photosensitive belt 10. The developing units 40 provide the developing solution to the photosensitive belt 10 having the electrostatic latent image to form a color image corresponding to the electrostatic latent image. The area of the photosensitive belt 10 in which the color image is formed is pressed and heated by the drying roller 50 while passing the drying roller 50. As a result, a carrier is removed from the developing solution that forms the color image. The color image formed on the photosensitive belt is transferred onto the transfer roller 24, and the image transferred onto the transfer roller 24 is transferred again onto the printing paper 60, which enters between the transfer roller 24 and the pressing roller 25, thereby completing the printing of an image onto the printing paper 60.

In the printer having the above structure, when the drying roller 50 presses the photosensitive belt 10 in order to remove carrier from the developing solution, toner contained in the image sticks to the drying roller, thereby lowering the quality of the image printed on the printing paper 60.

SUMMARY OF THE INVENTION

An objective of the present invention is to provide an electrophotographic printer capable of preventing toner contained in a developed developing solution on the surface of a photosensitive medium from sticking to a drying roller, thereby improving printing quality.

The electrophotographic printer includes: a photosensitive belt moving along a circular path and supported by a plurality of rollers; a main corona device for increasing an electrical charge potential on a surface of the photosensitive belt to a predetermined level for development; first, second, third and fourth laser scanning units (LSUs) for forming an electrostatic latent image on the photosensitive belt by color; first, second, third and fourth developing units for individually developing the electrostatic latent image by using first, second, third and fourth developing solutions of different colors; a drying roller pressing the photosensitive belt for removing carrier from the developing solutions developed on the photosensitive belt, the drying roller being frictionally charged positively through contact with the photosensitive belt; an eraser for removing an electrostatic charge remaining on the photosensitive belt after development to uniformly electrify the surface of the photosensitive belt with exposing charge potential; and a charge-increasing electrifying unit including a first topping corona device between the first developing unit and the second LSU, for increasing the electrical charge potential on the surface of the photosensitive belt, which was lowered during developing using the first developing solution, to a level for performing overlapping development using the second development solution, and a second topping corona device between the second developing unit and the third LSU, for increasing the electrical charge potential on the surface of the photosensitive belt, which was lowered during overlapping development using the first and second developing solutions, to a level for performing overlapping development using the third development solution, and a third topping corona device between the third developing unit and the fourth LSU, for increasing the electrical charge potential on the surface of the photosensitive belt, which was lowered during overlapping development using the first, second and third developing solutions, to a level for performing overlapping development using the fourth development solution.

According to another aspect of the invention, there is provided an electrophotographic printer comprising: a cylindrical photosensitive drum; an eraser for uniformly lowering an electrical charge potential on a surface of the drum to a level below an exposing charge potential; a main corona device for increasing the electrical charge potential on the surface of the drum to a predetermined level for development; a laser scanning unit (LSU) for forming an electrostatic latent image on the photosensitive drum; a developing unit disposed adjacent to the LSU, for developing the electrostatic latent image using a developing solution; a drying roller pressing the photosensitive drum for removing the carrier from the developing solution developed on the photosensitive drum, the drying roller being frictionally charged positively through contact with the photosensitive drum; and a charge-repelling topping corona device disposed between the developing unit and the drying roller, for increasing the electrical charge potential on the surface of the photosensitive drum so that positively-charged toner particles of the developing solution are repelled by the drying roller, thereby preventing sticking of the developing solution on the drying roller.

BRIEF DESCRIPTION OF THE DRAWINGS

The above objective and advantages of the present invention will become more apparent by describing in detail a preferred embodiment thereof with reference to the attached drawings, in which.

DESCRIPTION OF THE PREFERRED EMBODIMENTS

Figure 1:
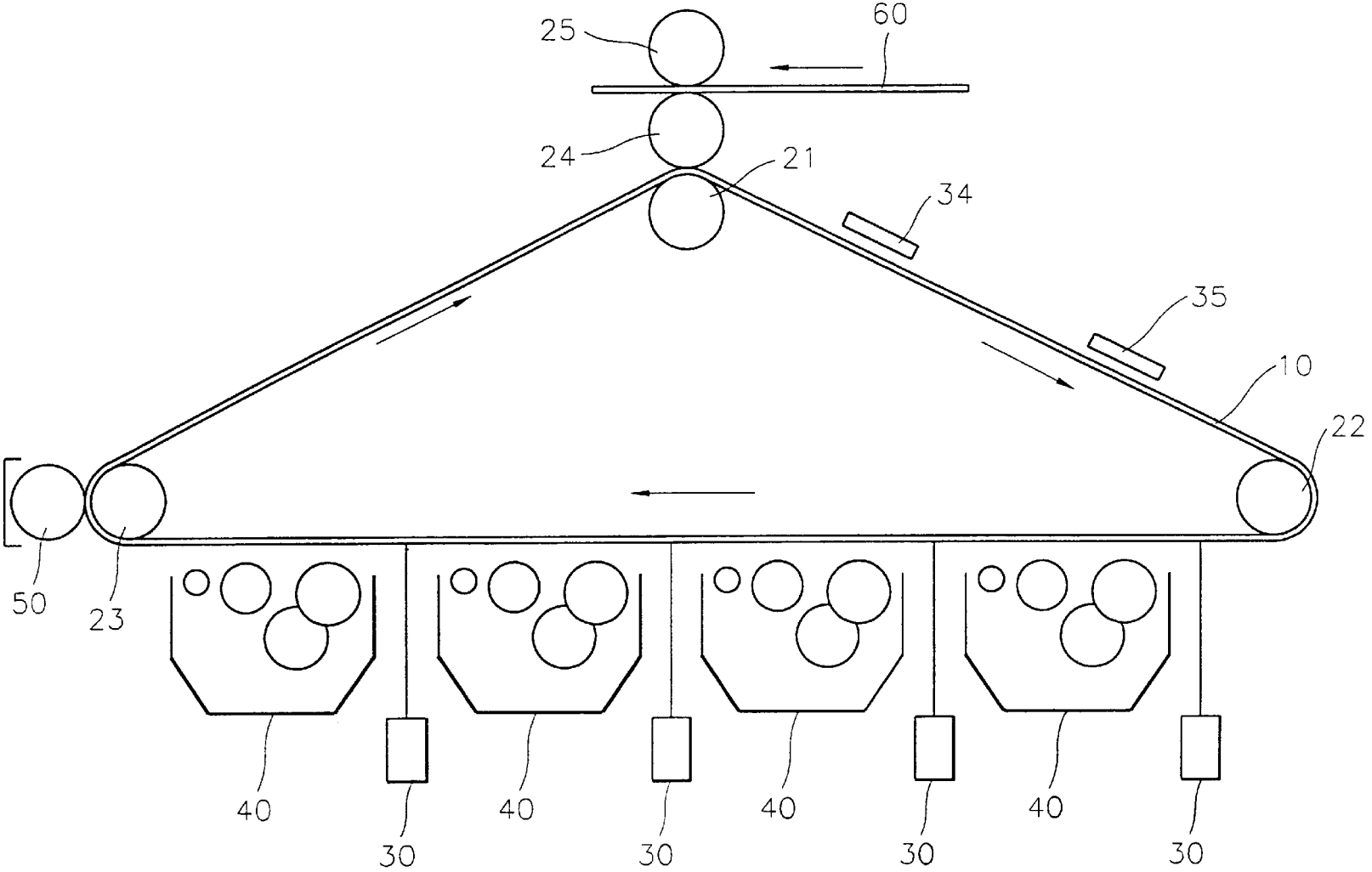
FIG. 1 (PRIOR ART)
FIG. 1 is a diagram schematically showing the structure of a conventional electrophotographic printer.
Figure 2:
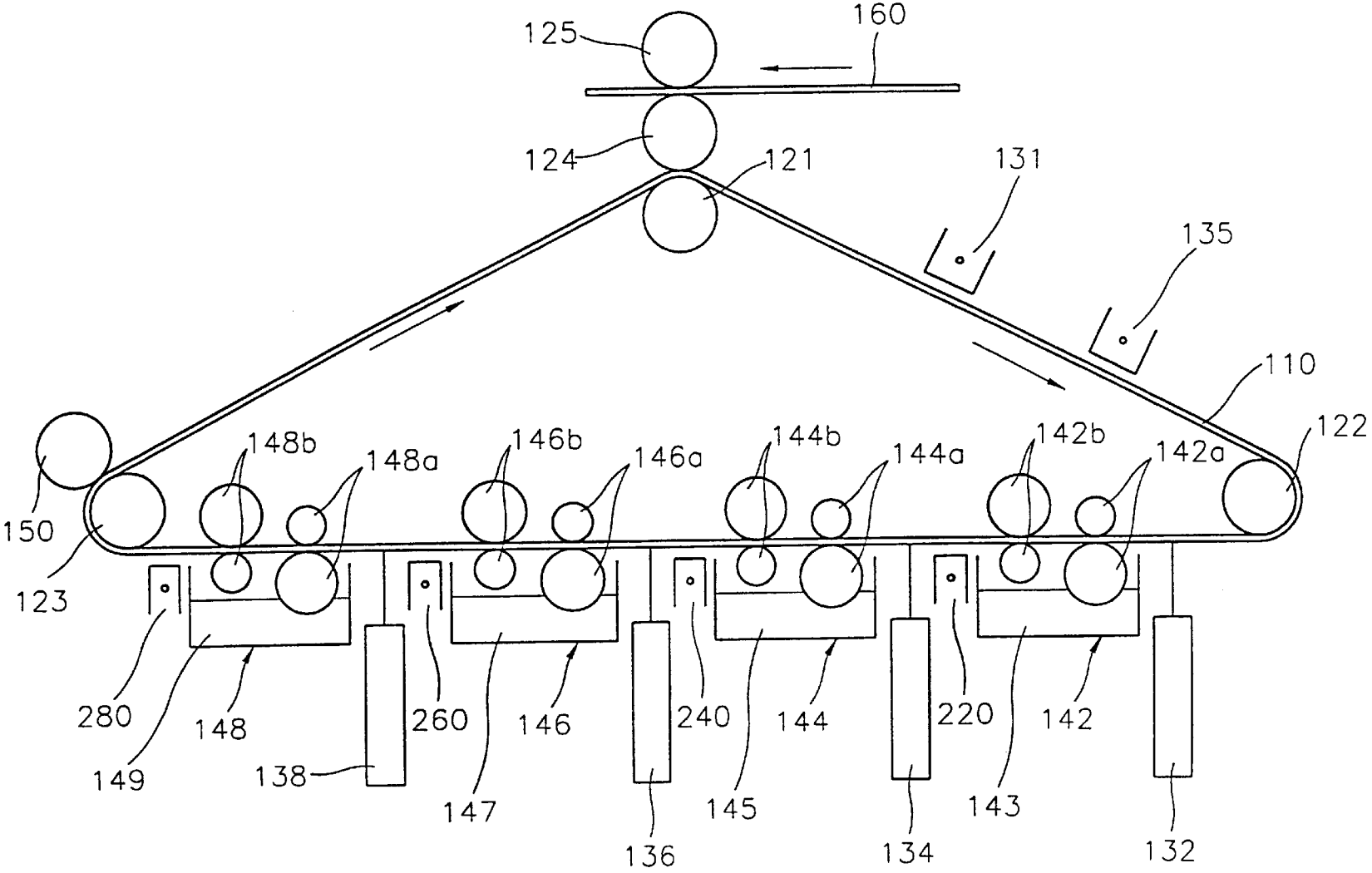
FIG. 2 is a diagram schematically showing the structure of an electrophotographic printer according to a preferred embodiment of the present invention.

As shown in FIG. 2, an electrophotographic printer according to a preferred embodiment of the present invention includes a photosensitive belt 110 making a circular movement, and three rollers including first, second and third rollers 121, 122 and 123 which are fixed at predetermined locations and circulate the photosensitive belt 110 in a closed loop.

The third roller 123 is a driving roller for conveying the photosensitive belt 110 by a driving force of a driving motor (not shown) and the second roller 122 is a steering roller for preventing slanted traveling by controlling the tension of the photosensitive belt 110.

A drying roller 150 is placed near the third roller 123, for removing the carrier from a developing solution developed on the photosensitive belt 110 in order to firmly adhere the image formed on the surface of the photosensitive belt 110. The drying roller 150 emits heat while pressing the photosensitive belt 110 against the third roller 123, so that the remaining carrier on the image is removed and simultaneously the image is firmly adhered to the photosensitive belt 110. The surface of the drying roller 150 is frictionally charged with (+) charges when contacting the photosensitive belt 110.

A transfer roller 124 is placed next to the first roller 121. An image formed on the photosensitive belt 110 is transferred to the transfer roller 124 as it rolls along the photosensitive belt 110. A pressing roller 125 is installed near the transfer roller 124. As the pressing roller 125 presses a printing paper 160, which enters between the transfer roller 124 and the pressing roller 125, against the transfer roller 124, the image transferred onto the transfer roller 124 is transferred onto the printing paper 160.

At one end of the photosensitive belt 110 between the first and second rollers 121 and 122, is an eraser 131 for lowering the electric potential on the surface of the photosensitive belt 110 to a level of an exposing charge potential (about 100V) before the photosensitive belt 110 is electrified. The eraser 131 includes a plurality of light-emitting diodes (LEDs, not shown) and the light emitted from the LEDs makes the electric charge potential at the surface of the photosensitive belt 110 about 100V.

A main corona device 135 is placed next to the eraser 131 for increasing the electric charge potential at the surface of the photosensitive belt to about 600~700V, preferably 650V for performing development. The main corona device 135 also includes a plurality of LEDs (not shown).

First, second, third and fourth laser scanning units (LSUs) 132, 134, 136 and 138 are disposed below the photosensitive belt 110 for forming an electrostatic latent image by irradiating laser beams on the photosensitive belt 110 according to an image signal.

First, second, third and fourth developing units 142, 144, 146 and 148 for respectively developing yellow, magenta, cyan and black developing solutions in the area having the electrostatic latent image, are alternately installed among the LSUs 132 through 138.

The first developing unit 142 includes a first developing roller 142*a* for supplying a yellow developing solution 143 obtained by mixing yellow toner particle (not shown) and a liquid carrier (not shown) to the photosensitive belt 110 having the electrostatic latent image, and a first squeegee roller 142*b* for press-rolling the photosensitive belt 110 in order to remove carrier from the yellow developing solution 143 developed on the surface of the photosensitive belt 110. The carrier removed by the first squeegee roller 142*b* is collected by the first developing unit 142 for reuse.

The second developing unit 144 includes a second developing roller 144*a* for supplying a magenta developing solution 145 obtained by mixing magenta toner particles (not shown) and a liquid carrier (not shown) to the photosensitive belt 110 having the electrostatic latent image, and a second squeeze roller 144*b* for press-rolling the photosensitive belt 110 in order to remove carrier from the magenta developing solution 145 developed on the surface of the photosensitive belt 110. The carrier removed by the second squeegee roller 144*b* is collected by the second developing unit 144 for reuse.

The third developing unit 146 includes a third developing roller 146*a* for supplying a cyan developing solution 147 obtained by mixing cyan toner particles (not shown) and a liquid carrier (not shown) to the photosensitive belt 110 having the electrostatic latent image, and a third squeegee roller 146*b* for press-rolling the photosensitive belt 110 in order to remove carrier from the cyan developing solution 147 developed on the surface of the photosensitive belt 110. The carrier removed by the third squeegee roller 146*b* is collected by the third developing unit 146 for reuse.

The fourth developing unit 148 includes a fourth developing roller 148*a* for supplying a black developing solution 149 obtained by mixing black toner particles (not shown) and a liquid carrier (not shown) to the photosensitive belt 110 having the electrostatic latent image, and a fourth squeegee roller 148*b* for press-rolling the photosensitive belt 111 in order to remove carrier from the black developing solution 149 developed on the surface of the photosensitive belt 110. The carrier removed by the fourth squeegee roller 148*b* is collected by the fourth developing unit 148 for reuse.

A potential-increasing electrifying device is installed near each developing unit, in order to increase the electrical charge potential at the surface of the photosensitive belt 110, which has been lowered during the developing process, to a level capable of achieving the development.

The potential-increasing electrifying device includes a first topping corona device 220 between the first developing unit 142 and the second LSU 134, a second topping corona device 240 between the second developing unit 144 and the third LSU 136, a third topping corona device 260 between the third developing unit 146 and the fourth LSU 138, and a charge-repelling topping corona device 280 between the fourth developing unit 148 and the drying roller 150, which prevents the toner particles of the developed developing solution from sticking to the drying roller 150.

A bias charge potential of about 400V is applied to respective developing rollers 142*a*, 144*a*, 146*a* and 148*a* of the first, second, third and fourth developing units 142, 144, 146 and 148. Thus, while the developing solution is developed on the photosensitive belt 110, the electrical charge potential at the surface of the photosensitive belt is decreased. The first, second and third topping corona devices 220, 240 and 260 increase the decreased electrical charge potential at the surface of the photosensitive belt to an electrical charge potential capable of performing development.

The first topping corona device 220 increases the electrical charge potential at the surface of the photosensitive belt 110, which has decreased to 400V during the development of the yellow developing solution, to an electrical charge potential of about 600~700V, preferably 650V such that overlapping development with the magenta developing solution 145 is achieved.

The second topping corona device 240 increases the electrical charge potential at the surface of the photosensitive belt 110, which has decreased to 400V during the overlapping development of the yellow and magenta developing solutions, to an electrical charge potential of about 600~700V, preferably 650V such that overlapping development with the cyan developing solution 147 is achieved.

The third topping corona device 260 increases the electrical charge potential at the surface of the photosensitive belt 110, which has decreased to 400V during the overlapping development of the yellow, magenta and cyan developing solutions, to an electrical charge potential of about 600~700V, preferably 650V such that overlapping development with the black developing solution 149 is achieved.

The charge-repelling topping corona device 280 increases the electrical charge potential at the surface of the photosensitive belt 110 to a repellable electrical charge potential of 600~700V, preferably 650V. As a result, the drying roller 150 which is frictionally charged by contact with the photosensitive belt 110 is positively (+) charged, and the positively-charged toner particles of the color developing solution electrically repel the drying roller 150. Accordingly, toner particles of the color developing solution after development are prevented from sticking to the drying roller 150.

The operation of the electrophotographic printer having the above structure is described next.

When an initial printing signal is transferred, the eraser 131 irradiates light onto the photosensitive belt 110 to uniformly electrify the surface of the photosensitive belt 110 to an exposing charge potential of about 100V. The main corona device 135 irradiates light onto the conveying photosensitive belt 110 to electrify the surface of the photosensitive belt 110 to an electrical charge potential of about 650V capable of achieving development.

Figure 3:
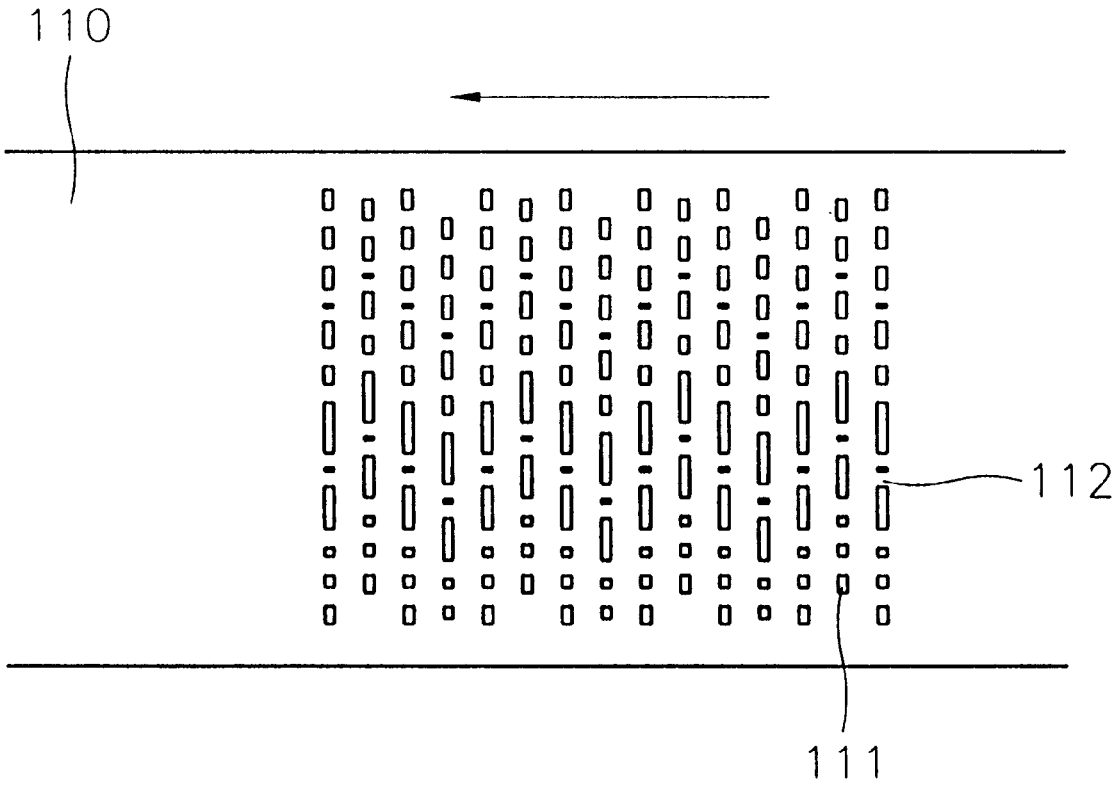
FIG. 3 is a diagram showing a pixel area and a non-pixel area which are formed on the surface of the photosensitive belt of FIG. 2.

When the electrified photosensitive belt 110 reaches the first LSU 132, the first LSU 132 irradiates laser beams corresponding to an image signal onto the photosensitive belt 110 to form an electrostatic latent image. The electrostatic latent image formed by the laser beams includes a pixel area 111 and a non-pixel area 112 as shown in FIG. 3. That is, an area onto which the laser beams are irradiated becomes the pixel area 111, and the other area onto which the laser beams are not irradiated becomes the non-pixel area 112. Here, the electrical charge potentials at the pixel area 111, and the non-pixel area 112 are different. That is, the electric charge potential at the pixel area 111 is lower than 650V, and that of the non-pixel area 112 is maintained at 650V. The toner particles of the developing solution are positively (+) charged, so that the toner particles adhere to the pixel area 111 having a lower electrical charge potential.

Figure 4:
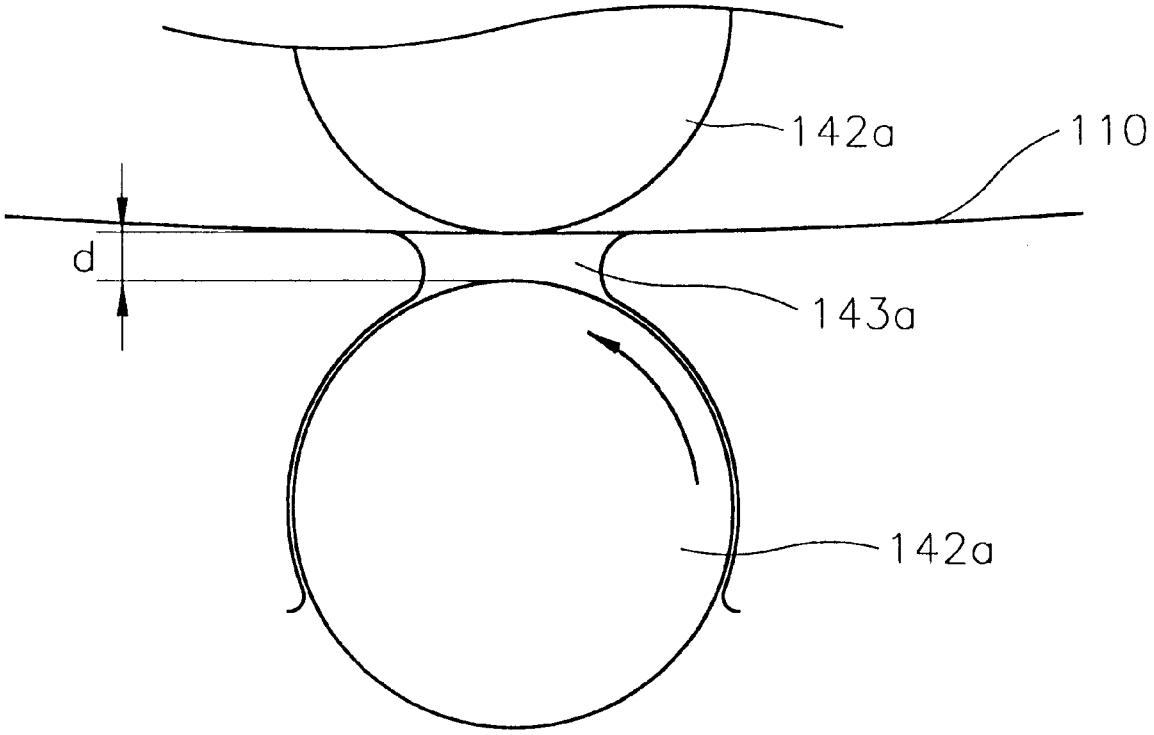
FIG. 4 is a diagram showing a liquid interface formed between the developing roller and the photosensitive belt of the developing unit shown in FIG. 2.

When the electrostatic latent image formed of the pixel area 111 and the non-pixel area 112 reaches the first developing unit 142, the yellow developing solution supplied by the first developing roller 142*a* of the first developing unit 142 is developed on the electrostatic latent image onto the photosensitive belt 110. As shown in FIG. 4, actually, there is a gap "d" between the surface of the first developing roller 142*a* and the surface of the photosensitive belt 110, and the gap "d" creates a fluid interface layer 143*a* formed by the yellow developing solution 143. The yellow toner particles move to the pixel area 111 of the electrostatic latent image via the fluid interface layer 143*a*. That is, only the pixel area 111 of the electrostatic latent image having a charge potential lower than 650V is developed by the yellow developing solution 143. Since a bias voltage of 400V has been applied to the first developing roller 142*a* of the first developing unit 142, charge equilibrium is achieved between the first developing roller 142*a* and the photosensitive belt 110 after the developing process, and accordingly the electrical charge potential at the surface of the photosensitive belt 110 decreases from 650V to 400V.

The photosensitive belt 100 having a surface electrical charge potential of 400V, which has completed the yellow development, goes through the first topping corona device 220. Since development is performed at an electrical charge potential of about 650V, the first topping corona device 220 irradiates light onto the photosensitive belt 110 to increase the surface electrical charge potential from 400V to 650V.

After development using the yellow developing solution, the photosensitive belt 110 whose electrical charge potential has increased to 650V reaches the second LSU 134. Then, the second LSU 134 irradiates laser beams according to an image signal corresponding to the development using the magenta developing solution to form an electrostatic latent image. As described above, an area onto which the laser beams are irradiated becomes a pixel area and the other area becomes a non-pixel area. Also, the electrical charge potential at the pixel area is lower than 650V, and that of the non-pixel area is maintained at 650V.

When the electrostatic latent image comprised by the pixel area and the non-pixel area reaches the second developing unit 144, the magenta developing solution is supplied to the pixel area of the electrostatic latent image by the second developing roller 144*a* of the second developing unit 144, such that the overlapping development is achieved.

In the same manner as above, since a bias voltage of about 400V has been applied to the second developing roller 144*a* of the second developing unit 144, charge equilibrium is achieved between the first developing roller 144*a* and the photosensitive belt 110 after the developing process, and accordingly the electrical charge potential at the surface of the photosensitive belt 110 decreases to 400V.

The photosensitive belt 100 which has completed the overlapping development using the yellow and magenta developing solutions goes through the second topping corona device 240. The second topping corona device 240 irradiates light onto the photosensitive belt 110 to increase the surface electrical charge potential of 400V to 650V to perform the next development.

After the overlapping development using the yellow and magenta developing solutions, the photosensitive belt 110 whose electrical charge potential has increased to 650V reaches the third LSU 136. Then, the third LSU 136 irradiates laser beams according to an image signal corresponding to the development using the cyan developing solution to form an electrostatic latent image. As described above, an area onto which the laser beams are irradiated becomes a pixel area and the other area becomes a non-pixel area. Also, the electrical charge potential at the pixel area is lower than 650V, and that of the non-pixel area is maintained at 650V.

When the electrostatic latent image formed of the pixel area and the non-pixel area reaches the third developing unit 146, the cyan developing solution is supplied to the pixel area of the electrostatic latent image by the third developing roller 146*a* of the third developing unit 146, such that the overlapping development of yellow and magenta developing solutions is achieved.

In the same manner as above, since a bias voltage of about 400V has been applied to the third developing roller 146*a* of the third developing unit 146, charge equilibrium is achieved between the developing roller 146*a* and the photosensitive belt 110 after the developing process, and accordingly the electrical charge potential at the surface of the photosensitive belt 110 decreases to 400V.

The photosensitive belt 100 which has completed the overlapping development using the yellow, magenta and cyan developing solutions goes through the third topping corona device 260. The third topping corona device 260 irradiates light onto the photosensitive belt 110 to increase the surface electrical charge potential of 400V to 650V to achieve the next development.

After the overlapping development using the yellow, magenta and cyan developing solutions, the photosensitive belt 110 whose electrical charge potential has increased to 650V reaches the fourth LSU 138. Then, the fourth LSU 138 irradiates laser beams according to an image signal corresponding to the development using the black developing solution to form an electrostatic latent image. As described above, an area onto which the laser beams are irradiated becomes a pixel area and the other area becomes a non-pixel area. Also, the electrical charge potential at the pixel area is lower than 650V, and that of the non-pixel area is maintained at 650V.

When the electrostatic latent image formed of the pixel area and the non-pixel area reaches the fourth developing unit 148, the black developing solution is supplied to the pixel area of the electrostatic latent image by the fourth developing roller 148*a* of the fourth developing unit 148, such that the overlapping development of yellow, magenta, cyan and black developing solutions is achieved.

In the same manner as above, since a bias voltage of about 400V has been applied to the fourth developing roller 148*a* of the fourth developing unit 148, charge equilibrium is achieved between the fourth developing roller 148*a* and the photosensitive belt 110 after the developing process, and accordingly the electrical charge potential at the surface of the photosensitive belt 110 decreases to 400V.

As a result, a color image is formed on the surface of the photosensitive belt 110 through overlapping development using the yellow, magenta, cyan and black developing solutions.

The photosensitive belt 100, on which the color image has been formed, goes through the charge-repelling topping corona device 280. The charge-repelling topping corona device 280 irradiates light onto the photosensitive belt 110 to increase the surface electrical charge potential of 400V to 650V.

The color image area developed onto the photosensitive belt 110 having the electrical charge potential of 650V goes through the dry roller 150, and the color image is pressed and heated by the drying roller 150 during this step. Accordingly, the carrier is removed from the developing solution of the color image, and the toner particles of the color developing solution comprised of Y, M, C and B developing solutions firmly adhere to the photosensitive belt. The drying roller is positively charged through friction with the photosensitive belt 110, and the positively-charged toner particles repel against the drying roller 150. As a result, the toner particles firmly adhere to the photosensitive belt 110, not to the drying roller 150.

The photosensitive belt 110 passed through the drying roller 150 contacts the transfer roller 124, and the color image formed on the photosensitive belt 110 is transferred onto the transfer roller 124. Then, the color image transferred onto the transfer roller 124 is transferred onto the printing paper which passes between the transfer roller 124 and the pressing roller 125.

An electrophotographic printer according to another preferred embodiment of the present invention is described in detail below.

Figure 5:
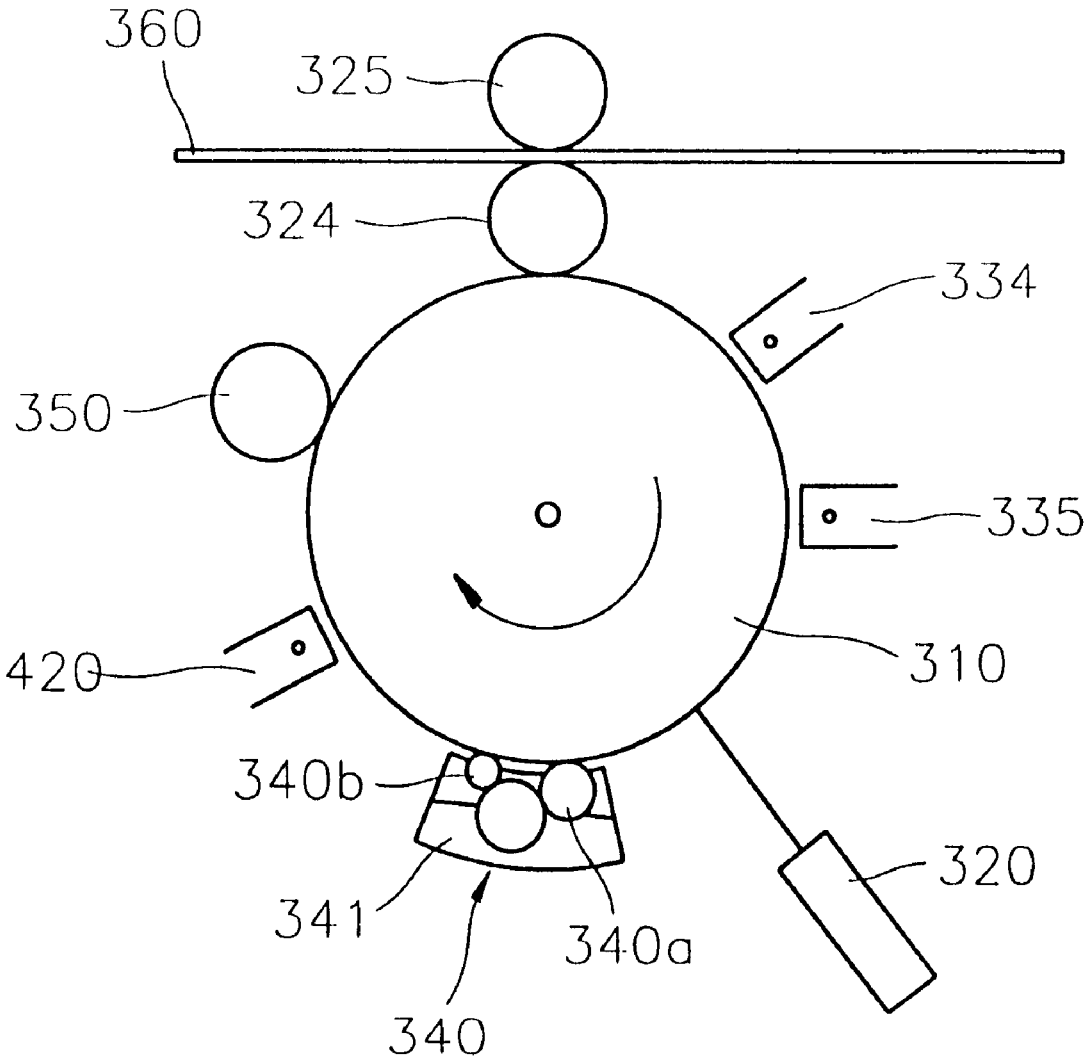
FIG. 5 is a diagram schematically showing the structure of an electrophotographic printer according to another preferred embodiment of the present invention.

FIG. 5 is a diagram schematically showing the structure of an electrophotographic printer according to another embodiment of the present invention. As shown in FIG. 5, the printer including a cylindrical photosensitive drum 310, a transfer roller 324 onto which an image formed on the photosensitive drum 310 is transferred while being rolled by the photosensitive drum 310, and a pressing roller 325 installed adjacent to the transfer roller 324. A printing paper 360 passes between the transfer roller 324 and the pressing roller 325. The image transferred onto the transfer roller 324 is transferred to the printing paper 360 as the pressing roller 325 presses the printing paper 360 against the transfer roller 324.

A drying roller 350 is for removing carrier from a developing solution 341 developed on the photosensitive drum 310 in order to firmly adhere the image formed on the surface of the photosensitive drum 310. The drying roller 350 is placed near the photosensitive drum 310. The drying roller 350 emits heat while pressing the photosensitive drum 310, so that the carrier remaining on the image is removed and simultaneously the image is firmly adhered to the photosensitive drum 310. The surface of the drying roller 350 is frictionally charged with positive charges when contacting the photosensitive drum 310.

An eraser 334 is placed at one end of the photosensitive drum 310 for uniformly lowering the electrical charge potential on the surface of the photosensitive drum 310 to a level below an exposing charge potential (about 100V). Also, a main corona device 335 is placed next to the eraser 334, for increasing the electrical charge potential at the surface of the photosensitive drum to about 600~700V, preferably 650V to achieve development. A laser scanning unit (LSU) 320 is also provided. The LSU irradiates laser beams onto the photosensitive drum 310 according to an image signal to form an electrostatic latent image, and a developing unit 340 is positioned near the LSU 320 for developing an electrostatic latent image using a developing solution 341.

The developing unit 340 includes a developing roller 340*a* for supplying the developing solution 341, which is obtained by mixing toner particles (not shown) and a liquid carrier (not shown), to the photosensitive drum 310 having the electrostatic latent image, and a squeegee roller 340*b* for press-rolling the photosensitive drum 310 in order to remove carrier from the developing solution 341 developed on the surface of the photosensitive drum 310. The carrier removed by the squeegee roller 340*b* is collected by the developing unit 340 for reuse.

A charge-repelling topping corona device 420 for preventing the toner particles from adhering to the drying roller 350 is installed between the developing unit 340 and the drying roller 350. The charge-repelling topping corona device 420 increases the electrical charge potential at the surface of the photosensitive drum 310 to a repellable electrical charge potential of 600~700V, preferably 650V. As a result, the drying roller 350, which is frictionally charged by contact with the photosensitive drum 310, is positively charged, and the positively-charged toner particles of the developing solution electrically repel the drying roller 350. Accordingly, the toner particles of the developing solution are prevented from sticking to the drying roller 350.

The operation of the electrophotographic printer having the above structure is described next.

When an initial printing signal is transferred, the eraser 334 irradiates light onto the photosensitive drum 310 to uniformly electrify the surface of the photosensitive drum 310 to an exposing charge potential of about 100V. The main corona device 335 irradiates light onto the rotating photosensitive drum 310 to electrify the surface of the photosensitive drum 350 to an electrical charge potential of about 650V capable of achieving development.

The LSU 320 irradiates laser beams corresponding to an image signal onto the electrified photosensitive drum 310 to form an electrostatic latent image. The electrostatic latent image formed by the laser beams includes a pixel area 111 and a non-pixel area 112 as shown in FIG. 3. That is, an area onto which the laser beams are irradiated becomes the pixel area 111, and the other area onto which the laser beams are not irradiated becomes the non-pixel area 112. The electrical charge potentials at the pixel area 111 and the non-pixel area 112 are different. That is, the electrical charge potential at the pixel area 11 is lower than 650V, and that of the non-pixel area 112 is maintained at 650V. The toner particles of the developing solution are positively charged, so that the toner particles adhere to the pixel area 111 having a lower electrical charge potential.

Figure 6:
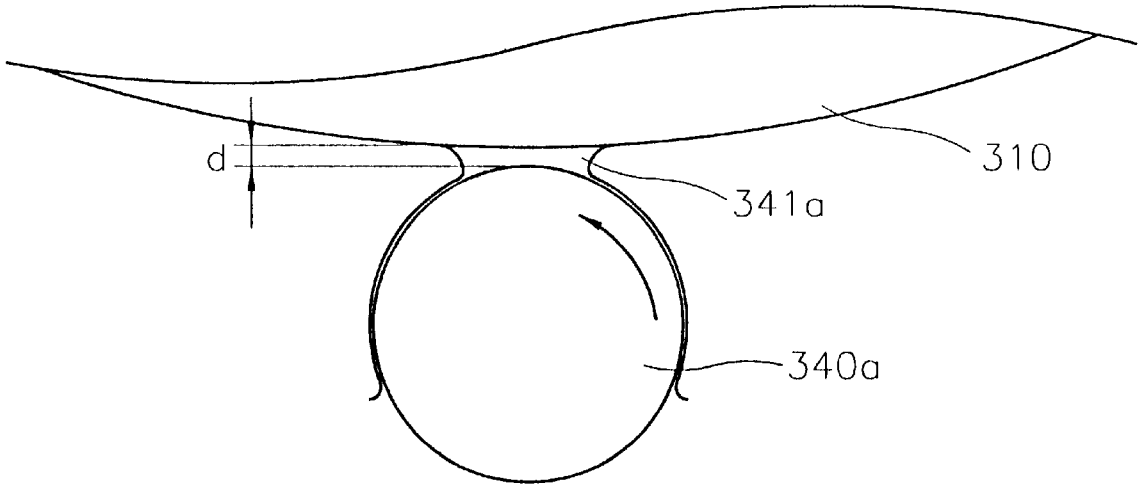
FIG. 6 is a diagram showing a liquid interface formed between the developing roller and the photosensitive drum of the developing unit shown in FIG. 5.

As shown in FIG. 6, there is a gap "d" between the surface of the developing roller 340*a* and the surface of the photosensitive drum 310, and the gap "d" creates a fluid interface layer 341*a* formed by the developing solution 341. The toner particles move to the pixel area 111 of the electrostatic latent image via the fluid interface layer 341*a*. That is, only the pixel area 111 of the electrostatic latent image having a charge potential lower than 650V is developed by the developing solution 341. Since a bias voltage of 400V has been applied to the developing roller 340*a* of the developing unit 340, charge equilibrium is achieved between the developing roller 340*a* and the photosensitive drum 310 after the developing process.

The photosensitive drum 310 which has completed the development goes through the charge-repelling topping corona device 420 having the surface electrical charge potential of 400V. The charge-repelling topping corona device 420 irradiates light onto the photosensitive drum 310 to increase the surface electrical charge potential of 400V to 650V.

The image area developed onto the photosensitive drum 310 having an electrical charge potential of 650V contacts the drying roller 350, and the image area is pressed and heated by the drying roller 350 during this step. Accordingly, the carrier is removed from the developing solution of the image, and the toner particles of the developing solution firmly adhere to the photosensitive drum 310. Since the drying roller is positively charged through friction with the photosensitive drum 310, the positively-charged toner particles repel against the drying roller 350. As a result, the toner particles firmly adhere to the photosensitive drum 310, not to the drying roller 350.

The image area formed on the photosensitive drum 310 contacts the transfer roller 324, and the image is transferred onto the transfer roller 324. The image transferred onto the transfer roller 324 is then transferred onto the printing paper 360 between the transfer roller 324 and the pressing roller 325, thereby completing the printing process of an image onto the printing paper 360.

As described above, the electrophotographic printer according to the present invention adopts a charge-repelling topping corona device, so that adhering of toner particles to the drying roller, which occurs when firmly adhering the image to a photosensitive medium, is prevented, thereby improving print quality.

What is claimed is:

1. An electrophotographic printer comprising:

a photosensitive belt (110) moving along a circular path and supported by a plurality of rollers (121, 122, 123);

a main corona device (135) for increasing an electrical charge potential on a surface of the photosensitive belt to a predetermined level for development;

first, second, third and fourth laser scanning units (132, 134, 136, 138) for forming an electrostatic latent image on the photosensitive belt by color;

first, second, third and fourth developing units (142, 144, 146, 148) for individually developing the electrostatic latent image using first, second, third and fourth developing solutions (143, 145, 147, 149) of different colors;

a drying roller (150) pressing said photosensitive belt for removing carrier from the developing solutions developed on the photosensitive belt, the drying roller being frictionally charged positively through contact with the photosensitive belt;

an eraser (131) for removing an electrostatic charge remaining on the photosensitive belt after development to uniformly electrify the surface of the photosensitive belt with exposing charge potential; and a potential-increasing electrifying unit including a first topping corona device (220) between the first developing unit (142) and the second laser scanning unit (134), for increasing the electrical charge potential on the surface of the photosensitive belt to a level for performing overlapping development using the second development solution (145), and a second topping corona device (240) between the second developing unit (144) and the third laser scanning unit (136), for increasing the electrical charge potential on the surface of the photosensitive belt to a level for performing overlapping development using the third development solution (147), and a third topping corona device (260) between the third developing unit (146) and the fourth laser scanning unit (138), for increasing the electrical charge potential on the surface of the photosensitive belt to a level for performing overlapping development using the fourth development solution (148).

2. The electrophotographic printer of claim 1, wherein the electrical charge potential for development is 600~700V.

3. The electrophotographic printer of claim 1, wherein the potential-increasing electrifying unit further includes a charge-repelling topping corona device (280) for increasing the electrical charge potential on the surface of the photosensitive belt so that positively-charged toner particles of the developing solutions are repelled by the drying roller, thereby preventing sticking of the developing solutions on the drying roller.

4. The electrophotographic printer of claim 3, wherein said charge-repelling topping corona device increases the electrical charge potential to 600~700V.

5. An electrophotographic printer comprising:

a cylindrical photosensitive drum (310);

an eraser (334) for uniformly lowering an electrical charge potential on a surface of said drum to a level below an exposing charge potential;

a main corona device (335) for increasing the electrical charge potential on the surface of said drum to a predetermined level for development;

a laser scanning unit (320) for forming an electrostatic latent image on the photosensitive drum;

a developing unit (340) disposed adjacent to the laser scanning unit, for developing the electrostatic latent image using a developing solution (341);

a drying roller (350) pressing said photosensitive drum for removing carrier from the developing solution developed on the photosensitive drum, said drying roller being frictionally charged positively through contact with said photosensitive drum; and a charge-repelling topping corona device (420) disposed between the developing unit (340) and the drying roller (350), for increasing the electrical charge potential on the surface of the photosensitive drum so that positively-charged toner particles of the developing solution are repelled by said drying roller, thereby preventing sticking of the developing solution on the drying roller.

6. The electrophotographic printer of claim 5, wherein said charge-repelling topping corona device increases the electrical charge potential to 600~700V.

* * * * *